United States Patent [19]

Davis

[11] Patent Number: 4,830,414

[45] Date of Patent: May 16, 1989

[54] LOCKING DEVICE FOR UTILITY METERS

[75] Inventor: George W. Davis, Warren, N.J.

[73] Assignee: Inner-Tite Corp., Springfield, N.J.

[21] Appl. No.: 94,497

[22] Filed: Sep. 9, 1987

[51] Int. Cl.[4] ..... B65D 33/34

[52] U.S. Cl. ..... 292/327

[58] Field of Search ..... 70/63, 159, 371, 158; 292/337, DIG. 38, DIG. 53

[56] References Cited

U.S. PATENT DOCUMENTS

| | | | |
|---|---|---|---|
| 2,113,744 | 4/1938 | Pixley et al. | 292/327 |
| 2,847,240 | 8/1958 | Stone et al. | 292/DIG. 38 X |
| 3,968,985 | 7/1976 | Nielsen, Jr. et al. | 70/63 X |
| 4,049,313 | 9/1977 | Lundberg | 70/159 X |
| 4,474,393 | 10/1984 | Kimura | 292/DIG. 38 X |
| 4,551,999 | 11/1985 | Guiler | 70/63 X |

*Primary Examiner*—Richard E. Moore

*Attorney, Agent, or Firm*—McCormick, Paulding & Huber

[57] ABSTRACT

A locking device for a meter socket includes a barrel lock receptacle carring a backing plate and snapped into assembly with the meter socket through an aperture in a wall of the socket. A barrel lock received within a bore in the lock receptacle secures one leg of an L-shaped locking bar adjacent the wall of the meter socket. The other leg of the locking bar overlies the meter socket cover and retains the cover in closed position.

10 Claims, 3 Drawing Sheets

LOCKING DEVICE FOR UTILITY METERS

BACKGROUND OF THE INVENTION

This invention relates to a locking device for utility meter sockets and the like. In particular, this invention concerns a locking device having a lock receptacle which snap-mounts into an aperture in a meter socket, which aperture may be punched in the field. The locking device does not require additional fasteners to secure the receptical to the meter socket, nor does it require a template to locate the position of the aperture.

Locking devices have been widely used in the past to prevent tampering with utility meters. While such devices deter attempts at tampering, their use generally involves a time consuming mounting procedure requiring fasteners and/or templates. For example, U.S. Pat. No. 3,968,985 employs a clip attached to a lock receptical for engaging the marginal edge portion of an associated meter socket wall. The clip holds the lock receptical in fixed position in the meter socket an in alignment with a lock receiving aperture formed in the associated wall of the socket. The aperture punched in the wall of the socket must be in proper registry with the lock receptical when the lock receptacle is mounted in fixed position within the meter socket. Any misalignment resulting from improper aperture location may be difficult, if not impossible, to correct.

The mounting procedure is both time consuming and costly. A template must be supplied to the workmen for locating the aperture in the meter socket, and the template must be employed correctly to obtain proper alignment between the aperture and the lock receptacle. Moreover, the clip must be supplied for attaching the lock receptacle to the meter socket.

Accordingly, it is the general aim of the present invention to provide an improved meter socket locking device of the barrel lock type which substantially eliminates problems of critical alignment between the lock receiving aperture formed in the meter socket and the lock receptacle mounted therein. It is a further aim of the invention to provide an improved locking device which may be installed on a utility meter socket without additional templates or other special alignment tools.

SUMMARY OF THE INVENTION

The present invention meets the above-stated aim by providing a locking device which can be snap-mounted onto a meter socket of the type having side walls which define an opening and including a cover forming a closure for the opening One of the side walls of the meter socket has an aperture punched therethrough for mounting the locking device.

The locking device itself includes a backing plate positioned within the meter socket adjacent the apertured side wall. The locking device also includes a lock receptacle in assembly with the backing plate and which is snap-mounted into the aperture in the side wall. The lock receptacle extends through the aperture and defines an outwardly opening bore. A generally L-shaped locking bar having a hole through one leg thereof is positioned on the outside of the meter socket with the hole through its leg in alignment with the outwardly opening bore. A barrel lock which extends through the hole in the locking bar and into the bore engages the lock receptacle in locked condition to maintain the locking bar in locking relation to the meter socket cover.

DETAILED DESCRIPTION OF PREFERRED EMBODIMENT

Figure 1:
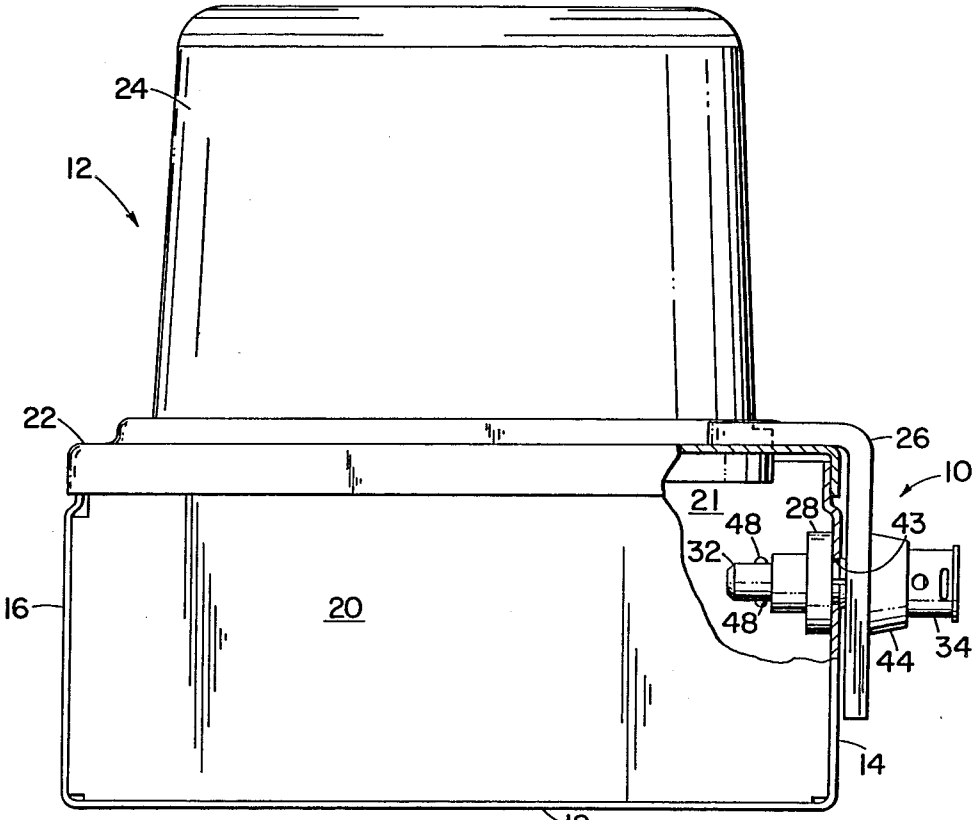
FIG. 1 is a partially cut away bottom view of a locking device embodying the invention in locking engagement with a utility meter.

FIG. 1 illustrates locking device embodying the present invention, indicated generally at 10, and shown in locking engagement with a meter socket, designated generally by the numeral 12. The meter socket 12 is of the type having a generally rectangular housing including side walls 14, and 16, a rear wall 18, a top wall 21 and a bottom wall 20. The side, rear, top and bottom walls of the socket define a frontal opening. The socket includes a cover 22 which is attached to the socket and forms a closure for the opening. The cover 22 has an opening and receives a meter canopy 24, which is preferably transparent.

Figure 2:
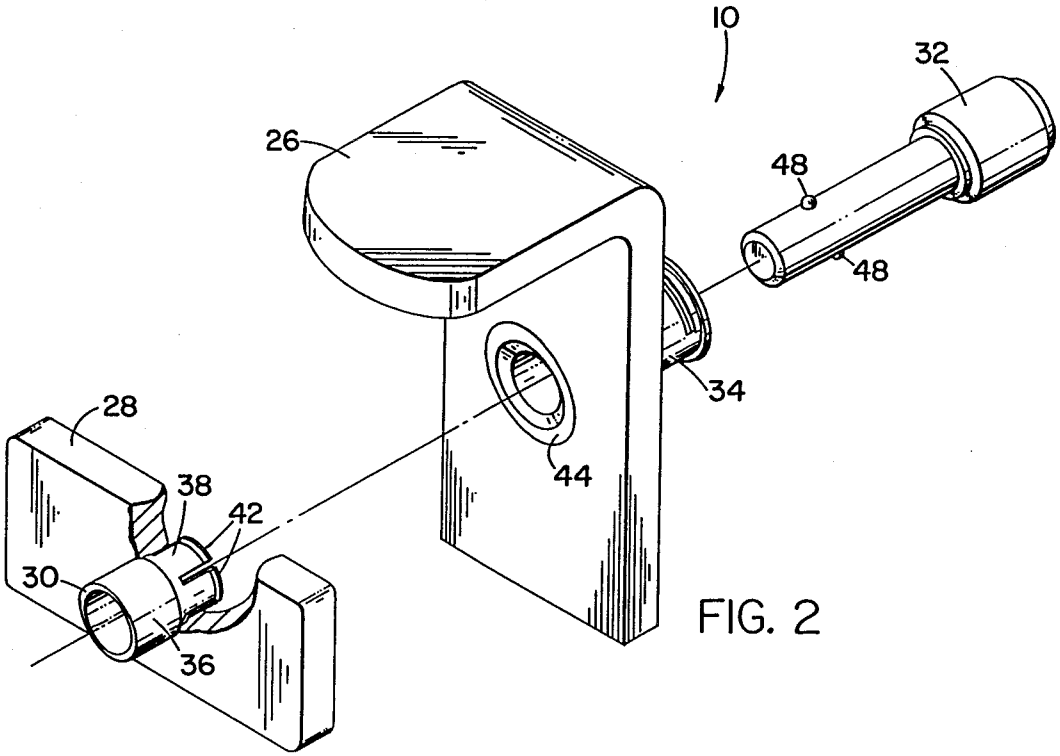
FIG. 2 is an exploded partially sectioned view of the locking device of FIG. 1 shown with a part of its backing plate broken away.

FIG. 2 illustrates the locking device 10 in greater detail. The locking device comprises a generally rectangular backing plate 28, a generally cylindrical lock receptacle 30, attached in press fit engagement with the backing plate, an L-shaped locking bar 26, a barrel lock 32 and a ferrule 34.

Figure 4:
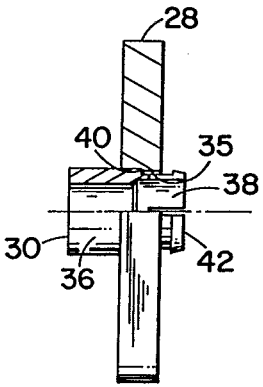
FIG. 4 is a sectional view taken along the line 4—4 of FIG. 3.
Figure 3:
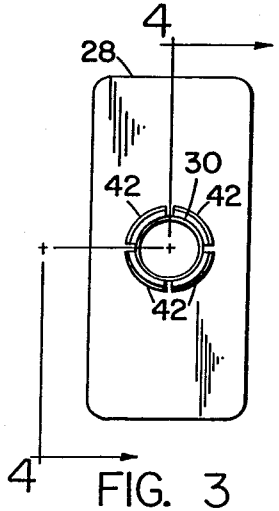
FIG. 3 is a front view of the lock receptacle of FIG. 1 shown in engagement with the locking plate.

As further illustrated in FIGS. 2, 3 and 4, the backing plate 28 has a generally cylindrical stepped hole 35 through it for receiving the lock receptacle 30. The lock receptacle 30 comprises an annular collar 36 having a plurality of resilient legs 38. The collar 36 and the resilient legs 38 cooperate to define a bore extending axially through the lock receptacle. The backing plate and the lock receptical are provided a one-piece assembly. The lock receptacle 30 is press fit into the stepped hole 35 in the backing plate 28 and is inserted into the hole 35 until the annular collar 36 abuts an annular engagement surface 40 defined by the stepped hole (shown best in FIG. 4). The press fit feature permits the backing plate 28 and the lock receptacle 30 to be mounted in a one step procedure on the socket 12 through a generally circular aperture 43 punched in side wall 14.

Figure 5:
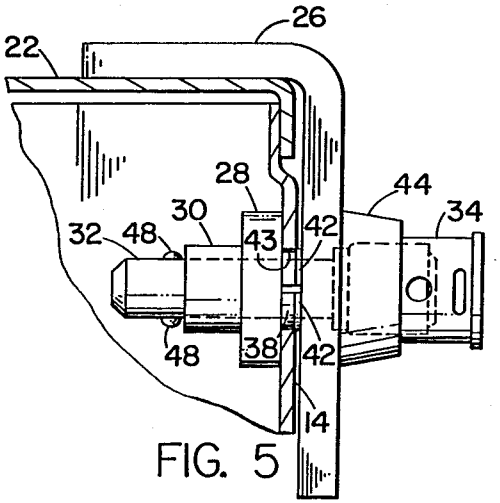
FIG. 5 is a somewhat enlarged fragmentary section view of the assembled locking device as it appears in FIG. 1.

FIG. 5 illustrates the locking device 10 mounted through the aperture 43 in side wall 14. FIG. 5 is illustrative of only one of the preferred embodiments of the instant invention. The locking device 10 may be mounted in either of the side walls 14 or 16 or in the bottom wall 20 without departing from the scope of the invention. The resiliency of the legs 38 enables the lock receptacle 30 to be snap-mounted into the aperture 43. The snap-mount of the receptacle onto the meter socket provides one of the major advantages of the present invention. Since, as stated above, the lock receptacle 30 and the backing plate 28 form a subassembly, both can be simultaneously mounted on the meter socket without need for fasteners of any kind. The lock receptacle 30 is simply pressed through the aperture 43 until the backing plate 28 engages the inside surface of side wall 14. Moreover, because the lock receptacle is snap-mounted in the aperture 43, the precise position of the aperture relative to the meter socket is not critical. Thus, the need for an additional template to ensure proper registry between the lock receptacle and the aperture is entirely eliminated. The snap-mount feature of the lock receptacle of the present invention permits absolute alignment of the receptacle with the aperture regardless of where the aperture is punched in the side or bottom wall of the socket.

The inner surfaces of the barbs 42 on the resilient legs 38 cooperate to form an annular abutment surface, which engages an associated annular portion of the outer surface of side wall 14 around the aperture 43. When the lock receptacle 30 and the backing plate 28 mounted on the socket 12 in this manner, the lock receptacle 30 defines an outwardly opening bore extending from the inside of the socket 12 through side wall 14.

The L-shaped locking bar 26 has a hole through one of its legs. A collar 44 is attached to the locking bar and at least partially defines the bore. The locking bar 26 is positioned on the meter socket 12 with its one leg adjacent the outer surface of side wall 14 and the bore in the one leg thereof in alignment with the outwardly opening bore defined by the lock receptacle 30. The other leg of the locking bar is positioned in an overlying relationship with an associated portion of cover 22. Prior to punching aperature 43, the locking bar 26 may be placed on the meter socket and the hole in the leg of the locking bar may be utilized to spot the location of the aperture 43 through sidewall 14 with sufficient accuracy. As stated above, the snap-mounted feature of lock receptacle 30 eliminates the nee for an additional template to precisely locate the aperature 43 relative to the meter socket.

To lockingly engage the locking device 10 with the socket 12, a barrel lock 32 is inserted through the hole in the L-shaped locking bar 26 and through the bore defined by the lock receptacle 30. The barrel lock 32 is of the conventional type well known in the art. The barrel lock 32 has two locking balls 48,48 which extend laterally outwardly beyond the cylindrical surface of the barrel lock and engage the end of lock receptacle 30 within the meter socket 12 when the barrel lock is in its locked condition. While the locking balls 48,48 are in engagement with the lock receptacle 30, the barrel lock 32 cannot be dislodged from the locking device 10. A free wheeling lock ferrule 34 is or may be fitted to the exposed end of the collar 44, and a security seal is attached to the lock ferrule 34 to indicate attempts at tampering.

While the present invention has been described in one particular embodiment, modifications may be made therein by a person skilled in the art without departing from the scope of the invention as expressed in the claims.

I claim;

1. A locking device for a meter socket having a body including walls defining an opening and having a cover forming a closure for the opening, one wall having an aperture there through, said locking device comprising a backing plate means for maintaining said backing plate within a meter socket such as aforesaid and generally adjacent a portion of the one wall, the means for maintaining including a lock receptacle for extending outwardly through said aperture and defining an outwardly opening bore and means for securing said lock receptacle in snap-in assembly with the meter socket, a generally L-shaped locking bar with said lock receptacle extending a hole through one leg thereof, and a barrel lock received within said bore for lockingly engaging said lock receptacle within the meter socket and maintaining said locking bar in locking relation to said meter socket with said one leg generally adjacent the one wall and the other leg of said locking bar in overlying relation to an associated portion of the cover.

2. A locking device for a meter socket as set forth in claim 1 wherein said securing means comprises a plurality of resilient legs on said lock receptacle for extending outwardly through the aperture.

3. A locking device for a meter socket as set forth in claim 2 wherein said lock receptacle further comprises an annular collar and said collar and resilient legs cooperate to define said bore.

4. A locking device for a meter socket as set forth in claim 2 wherein said securing means further includes barbs projecting outwardly from said resilient legs.

5. A locking device for a meter socket as set forth in claim 4 wherein said bore is generally cylindrical and said barbs project radially outwardly from said legs and define generally axially inwardly facing abutment surfaces for engaging the associated portions of the outer surface of the one wall.

6. A locking device for a meter socket as set forth in claim 1 further including a collar attached to said locking bar and at least partially defining said hole.

7. A locking device for a meter socket as set forth in claim 1 including means for holding said backing plate in assembly with said lock receptacle.

8. A locking device as set forth in claim 7 wherein said holding means comprises an annular engagement surface on said backing plate and said annular collar of said lock receptical and wherein said lock receptical is press fitted into said backing plate so that said annular collar abuts said annular engagement surface.

9. A locking device for meter sockets comprising:

a backing plate having a hole therethrough;

a lock receptacle having an annular collar and a plurality of resilient legs which cooperate to define a cylindrical bore, said resilient legs having barbs projecting radially outwardly from the ends thereof, said barbs defining inwardly facing abutment surfaces;

means for holding said lock receptacle in assembly with said backing plate, said holding means comprising said annular collar of said lock receptacle and an annular engagement surface on said backing plate, wherein said lock receptacle is press fitted into said backing plate so that said annular engagement surface abuts said collar of said lock receptacle;

a generally L-shaped locking bar having a hole through one leg thereof, said locking bar having a collar attached thereto, said collar at least partially defining said hole; and a barrel lock extending through said hole in said locking bar and through said cylindrical bore of said lock receptacle such that when said backing plate is in assembly with said lock receptacle, said barrel lock lockingly engages said locking bar, said lock receptacle and said backing plate.

10. The locking device of claim 1 wherein the backing plate and the lock receptacle comprises a pre-assembled combination for installation in the meter socket.

* * * * *